US007070471B2

(12) United States Patent
Shiokawa et al.

(10) Patent No.: US 7,070,471 B2
(45) Date of Patent: Jul. 4, 2006

(54) PRODUCTION METHOD FOR PLASMA DISPLAY PANEL

(75) Inventors: Akira Shiokawa, Osaka (JP); Hiroyosi Tanaka, Kyoto (JP); Yoshiki Sasaki, Shijounawate (JP); Masafumi Ookawa, Neyagawa (JP); Junichi Hibino, Neyagawa (JP)

(73) Assignee: Matsushita Electric Industrial Co. Ltd., Osaka-fu (JP)

( * ) Notice: Subject to any disclaimer, the term of this patent is extended or adjusted under 35 U.S.C. 154(b) by 432 days.

(21) Appl. No.: 10/239,668

(22) PCT Filed: Mar. 29, 2001

(86) PCT No.: PCT/JP01/02657

§ 371 (c)(1),
(2), (4) Date: Sep. 24, 2002

(87) PCT Pub. No.: WO01/75926

PCT Pub. Date: Nov. 10, 2001

(65) Prior Publication Data

US 2003/0077972 A1 Apr. 24, 2003

(30) Foreign Application Priority Data

Mar. 31, 2000 (JP) ..... 2000-099572
May 12, 2000 (JP) ..... 2000-140839

(51) Int. Cl.
*H01J 9/00* (2006.01)
*H01J 9/46* (2006.01)

(52) U.S. Cl. ..... 445/24; 445/25

(58) Field of Classification Search ..... 445/24, 445/25

See application file for complete search history.

(56) References Cited

U.S. PATENT DOCUMENTS

| | | | | | |
|---|---|---|---|---|---|
| 5,938,494 | A | * | 8/1999 | Betsui et al. | 445/24 |
| 6,533,630 | B1 | * | 3/2003 | Terajima et al. | 445/24 |
| 6,666,738 | B1 | * | 12/2003 | Kado et al. | 445/6 |
| 2004/0053555 | A1 | * | 3/2004 | Sasaki et al. | 445/25 |
| 2004/0072495 | A1 | * | 4/2004 | Yonehara et al. | 445/59 |
| 2004/0106350 | A1 | * | 6/2004 | Sasaki et al. | 445/24 |

FOREIGN PATENT DOCUMENTS

| | | | | |
|---|---|---|---|---|
| JP | 05234512 | A | | 9/1993 |
| JP | 10106441 | A | | 4/1998 |
| JP | 11076922 | A | | 3/1999 |
| JP | 11283502 | A | | 10/1999 |
| JP | 11297676 | A | | 10/1999 |
| JP | 2000011888 | A | | 1/2000 |
| JP | 2000076989 | A | | 3/2000 |
| JP | 2000-294133 | | | 10/2000 |
| JP | 2002319349 | A | * | 10/2002 |
| WO | WO 9966525 | A1 | * | 12/1999 |

* cited by examiner

*Primary Examiner*—Mariceli Santiago

(57) ABSTRACT

A manufacturing apparatus for a PDP includes a unit for forming a protective layer protecting a dielectric layer on a first plate, a unit for baking a phosphor layer applied on a second plate, a unit for sealing the first and second plates arranged so that the protective layer faces the phosphor layer, and a unit for baking the first and second plates while exhausting a space between them. The four units are placed in one or more closed chamber. When the apparatus is driven, spaces in and between the closed chambers each contain a gas atmosphere with vapor partial pressure of 10 mPa or lower, or with a pressure of 1 Pa or lower, where the protective layer and the phosphor layer exhibit less water-absorbing property, preventing degradation of the PDP performances. The protective layer does not contact with atmospheric carbonic acid gas, preventing alteration thereof.

29 Claims, 6 Drawing Sheets

PRODUCTION METHOD FOR PLASMA DISPLAY PANEL

TECHNICAL FIELD

The present invention relates to a plasma display panel, and a manufacturing method for the same.

BACKGROUND ART

In response to recent demands for higher performances of displays such as higher definitions and larger screens, active developments have been made in various types of displays.

Representatives of displays currently calling attentions are cathode-ray tubes (CRTs), liquid crystal displays (LCDs), and plasma display panels (PDPs).

A PDP typically has the following construction. Two thin glass plates on which a plurality of electrodes and a dielectric film (a dielectric layer) are formed are placed to face each other, with a plurality of barrier ribs interposed between them. A phosphor layer is formed between every adjacent barrier ribs, and a discharge gas is enclosed between the two glass plates. The two glass plates are hermetically sealed. In such a PDP, power is supplied to the plurality of electrodes, so that an electric discharge occurs within the discharge gas. This electric discharge causes the phosphors to emit light. Unlike a CRT, therefore, a PDP is advantageous in that its depth and weight do not have to be increased accordingly when a screen size of the PDP is increased. Also, unlike an LCD, a PDP is advantageous in that its viewing angle is not limited. In recent years, large-screen PDPs of 50-inch class or larger have already been commercialized.

In a PDP, a protective layer made of magnesium oxide is usually provided on a dielectric film on a glass plate that is positioned to face phosphor layers, in view of protecting the dielectric film against damages.

This protective layer is formed, for example, by spattering. To form a protective layer with good quality, defective factors that may arise at the time of spattering, such as contamination with impurities and generation of static electricity, need to be eliminated. In view of this, moisture is introduced in an atmosphere so as to have a predetermined vapor partial pressure (e.g. approximately 1.5 kPa) where a protective layer forming step is performed. The moisture is considered to reduce impurities suspending in the atmosphere, and also, to reduce static electricity being generated.

The problem is, however, that magnesium oxide possesses the property of absorbing water, and has the property of altering when containing water. Therefore, if the protective layer made of magnesium oxide comes in contact with an atmosphere containing a predetermined amount or more of water vapor, its performances may be degraded.

Also, if moisture is absorbed into the protective layer, the moisture is partially moved toward the phosphor layers during or after the manufacturing of a PDP, causing performances of the phosphor layers to be degraded. Due to this, display performances of the PDP may be degraded.

Further, magnesium oxide also possesses the property of reacting with an atmospheric carbonic acid gas to form magnesium carbonate. If this reaction occurs, too, performances of the protective layer made of magnesium oxide may be degraded.

Also, a large amount of water vapor contained in the atmosphere may cause an erroneous discharge at the time of spattering.

With the problems described above, there still is much room for improvements in manufacturing PDPs to obtain favorable display performances.

The present invention has been made in view of the above problems, and has as an object the provision of a method for manufacturing a PDP with excellent luminous efficiency particularly by forming a protective layer and phosphor layers with good quality. Further, the present invention has as another object the provision of a manufacturing apparatus for such a PDP.

DISCLOSURE OF THE INVENTION

To solve the above problems, the present invention relates to a manufacturing method for a plasma display panel that includes: a protective layer forming step of forming a protective layer on one main surface of a first plate, the protective layer protecting a dielectric layer; a phosphor layer baking step of baking a phosphor layer that has been applied on one main surface of a second plate; a sealing step of sealing the first plate and the second plate that have been placed in such a manner that the main surface on which the protective layer has been formed faces the main surface on which the phosphor layer has been baked; and a baking and exhausting step of baking the first plate and the second plate while exhausting a space formed between the first plate and the second plate, wherein in each of the four steps and between every successive two of the four steps, the first plate and the second plate are continuously in a first gas atmosphere with a vapor partial pressure of 10 mPa or lower, or in a second gas atmosphere with a pressure of 1 Pa or lower.

According to this method, the front and back panels can continuously be in such a gas atmosphere described above throughout the protective layer forming step, the phosphor layer baking step, the sealing step, and the baking/exhausting step, and also between these steps. This means that the protective layer can be in a gas atmosphere containing a small amount of moisture from the protective layer forming step through the baking/exhausting step. This also means that the phosphor layers can be in a gas atmosphere containing a small amount of moisture from the phosphor layer baking step through the baking/exhausting step. Therefore, degradation of the protective layer due to moisture can be reduced, and further, degradation of the phosphor layers can be avoided.

Further, according to this method, the protective layer does not come in contact with an atmospheric carbonic acid gas. In addition to the above-described effects, therefore, alteration of the protective layer due to a carbonic acid gas can also be prevented.

Because the above four steps are continuously performed in a closed chamber, a gas atmosphere in which the above steps are performed can be prevented from being contaminated with impurities, and further, generation of static electricity can be reduced.

Note here that to create a gas atmosphere containing such an amount of water vapor that effectively suppresses the water-absorbing property of magnesium oxide constituting the protective layer, a pressure is set at 1 Pa and a vapor partial pressure is set at 10 mPa. These values have resulted from devoted examinations of the inventors of the present application.

As the above dry gas, an oxygen gas or a gas containing oxygen can be used in the phosphor layer baking step and in the sealing step. In general, as a dry gas, a gas mainly composed of one of an inert gas and nitrogen, or a gas mainly composed of a mixture of oxygen and an inert gas can be used.

In the present invention, it is preferable to heat the first plate on which the protective layer has been formed for retaining heat therein, during an interval between an end of the protective layer forming step and a start of the sealing step. This is because that the retained heat in the first plate that is in a high temperature state immediately after the protective layer has been formed thereon can be utilized in the subsequent sealing step. If the heat in the first plate can be retained, the first plate does not need to be heated so much in the subsequent sealing step. Accordingly, the sealing step can be performed quickly.

Here, it is preferable to set the heating temperature of the first plate at 120° C. or higher because this temperature is optimum for effectively retaining heat in the first plate on which the protective layer has been formed and for reducing an amount of moisture absorbed from the gas atmosphere into the protective layer. Here, a maximum value for this heating temperature is determined by a heat-resistant temperature of the first plate. Therefore, it is needless to say that the maximum value for the heating temperature should be set in such a range that takes the heat-resistant temperature into consideration (specifically in a range of 120 to 150° C.).

Also, during the interval between the end of the protective layer forming step and the start of the sealing step, an examination of the protective layer may be performed. By this examination, the first plate whose protective layer is defective can be rejected prior to the sealing step.

Further, during an interval between the end of the protective layer forming step and the start of the sealing step, cleaning of the protective layer may be performed. The cleaning of the protective layer may be realized, for example, using a method of discharging the surface of the protective layer.

The present invention also relates to a manufacturing apparatus for a plasma display panel that includes: a protective layer forming unit for forming a protective layer on one main surface of a first plate, the protective layer protecting a dielectric layer; a phosphor layer baking unit for baking a phosphor layer that has been applied on one main surface of a second plate; a sealing unit for sealing the first plate and the second plate that have been placed in such a manner that the main surface on which the protective layer has been formed faces the main surface on which the phosphor layer has been baked; and a baking and exhausting unit for baking the first plate and the second plate while exhausting a space formed between the first plate and the second plate, wherein the protective layer forming unit, the phosphor layer baking unit, the sealing unit, and the exhausting and baking unit are positioned in one or more closed chambers, when the manufacturing apparatus is driven, spaces in and between the one or more closed chambers each contain a first gas atmosphere with a vapor partial pressure of 10 mPa or lower, or a second gas atmosphere with a pressure of 1 Pa or lower.

This manufacturing apparatus enables the above manufacturing method to be realized. Accordingly, a PDP that includes a protective layer and phosphor layers with good quality and that can exhibit excellent display performances can be manufactured.

DESCRIPTION OF THE PREFERRED EMBODIMENT

1. First Embodiment

1.1 Construction of the PDP

Figure 1:
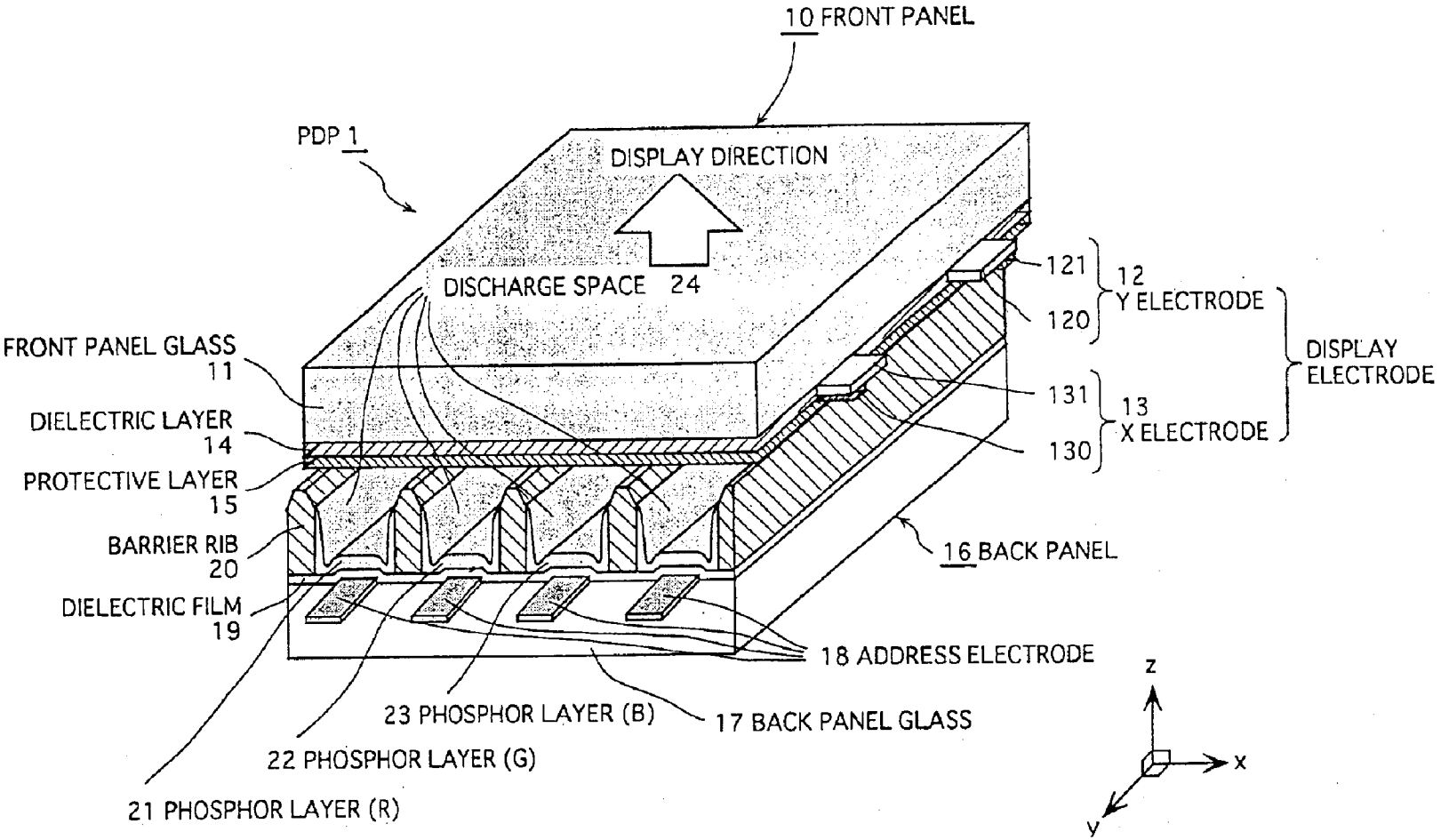
FIG. 1 shows the essential components of a PDP relating to a first embodiment of the present invention.

FIG. 1 is a sectional perspective view showing the essential components of an alternating current (AC) surface discharge type plasma display panel 1 relating to the first embodiment (hereafter simply referred to as "PDP 1"). In the figure, the direction z corresponds to the thickness direction of the PDP 1, and the plane x-y corresponds to a plane that is parallel to the panel surface of the PDP 1. As one example, the PDP 1 here is assumed to be a 42-inch class PDP that complies with the NTSC specifications. The present invention, however, may instead employ other sizes and specifications.

As FIG. 1 shows, the PDP 1 is mainly composed of a front panel 10 and a back panel 16 that are arranged with respective main surfaces facing each other.

On one main surface of a front panel glass 11 that is a substrate for the front panel 10, belt-shaped transparent electrodes 120 and 130 (with a thickness of 0.1 μm and a width of 150 μm) and bus lines 121 and 131 (with a thickness of 7 μm and a width of 95 μm) are laminated, to form pairs of display electrodes 12 and 13 (X electrodes 13 and Y electrodes 12).

The entire main surface of the front panel glass 11 on which the display electrodes 12 and 13 are formed is covered by the a dielectric layer 14 with a thickness of about 30 μm and a protective layer 15 with a thickness of about 1.0 μm in the stated order.

On one main surface of a back panel glass 17 that is a substrate for the back panel 16, a plurality of address electrodes 18 with a thickness of 5 μm and a width of 60 μm are arranged in stripes at fixed intervals (360 μm) in the direction x, with their longitudinal direction being the direction y. The entire surface of the back panel glass 17 is covered with a dielectric glass film 19 with a thickness of 30 μm so as to cover the address electrodes 18. On the dielectric glass film 19, barrier ribs 20 (with a height of about 150 μm and a width of about 40 μm) are arranged in such a manner that one barrier rib 20 is present between every two adjacent address electrodes 18. Phosphor layers 21 to 23 respectively corresponding to red (R), green (G), and blue (B) are formed, in such a manner that one phosphor layer is present on the side surfaces of every two adjacent barrier ribs 20 and a portion of the surface of the dielectric glass film 19 exposed between the two adjacent barrier ribs 20.

The front panel 10 and the back panel 16 constructed as above are arranged to face each other in such a manner that the longitudinal direction of the address electrodes 18 is perpendicular to the longitudinal direction of the display electrodes 12 and 13. Peripheral parts of the panels 10 and 16 are sealed via a glass frit. A discharge gas (enclosure gas) that is made up of inert gas elements such as He, Xe, and Ne is enclosed between the panels 10 and 16 at a predetermined pressure (usually about 500 to 760 Torr).

A discharge space 24 is formed between every two adjacent barrier ribs 20. A region formed by a pair of adjacent display electrodes 12 and 13 crossing over one address electrode 18 across the discharge space 24 corresponds to a cell that relates to an image display. A cell pitch is 1080 μm in the direction x and 360 μm in the direction y.

1.2 Operations of the PDP

The PDP 1 is driven in the following way. A panel-driving unit (not shown) applies a pulse to the address (scanning) electrodes 18 and the display electrodes 12, so that a write discharge (an address discharge) occurs. Following this, the panel-driving unit applies a sustaining discharge pulse between the pairs of the display electrodes 12 and 13, so that a sustained discharge occurs. This results in an image display being produced.

Here, main characteristics of the first embodiment lay in steps of manufacturing the protective layer 15 and the phosphor layers 21 to 23 of the PDP 1.

In the first embodiment, a dry gas atmosphere apparatus 100 is provided. Using the dry gas atmosphere apparatus 100, as described in detail later, steps of: forming the protective layer 15 (forming a magnesium oxide layer); baking the phosphor layers 21 to 23; sealing the front and back panels 10 and 16 together; and baking and exhausting the front and back panels 10 and 16, are continuously performed in a dry gas atmosphere.

It is usually preferable to perform the protective layer forming step in an atmosphere containing a predetermined amount of waver vapor, in view of avoiding problems caused by the protective layer contaminated with impurities, generation of static electricity, etc. However, the protective layer 15 made of magnesium oxide possesses water-absorbing property, and therefore, a large amount of moisture present in the atmosphere may cause magnesium oxide constituting the protective layer 15 to alter to form magnesium hydroxide or the like. This may degrade the functions of the protective layer (more specifically the function of protecting the dielectric layer and the function of emitting secondary electrons). Also, the moisture absorbed into the protective layer can move toward the phosphor layers after the sealing step, and may denature the phosphor layers. As a result, display performances of the PDP may be degraded. Also, magnesium oxide constituting the protective layer 15 possesses the property of reacting with a carbonic acid gas when coming in contact with air. Due to this reaction, too, the protective layer may be denatured.

To solve these problems, each of the above-listed steps is performed in a dry gas atmosphere as described above, so as to reduce moisture to be contained in the protective layer 15 and in the phosphor layers 21 to 23. As a result, the protective layer 15 with high purity can be formed by avoiding moisture absorption and reaction with a carbonic acid gas. This protective layer 15 with high purity can then prevent the phosphor layers 21 to 23 from being denatured when the PDP is operated, thereby enabling display performances to be improved further as compared with a conventional PDP.

Figure 2:
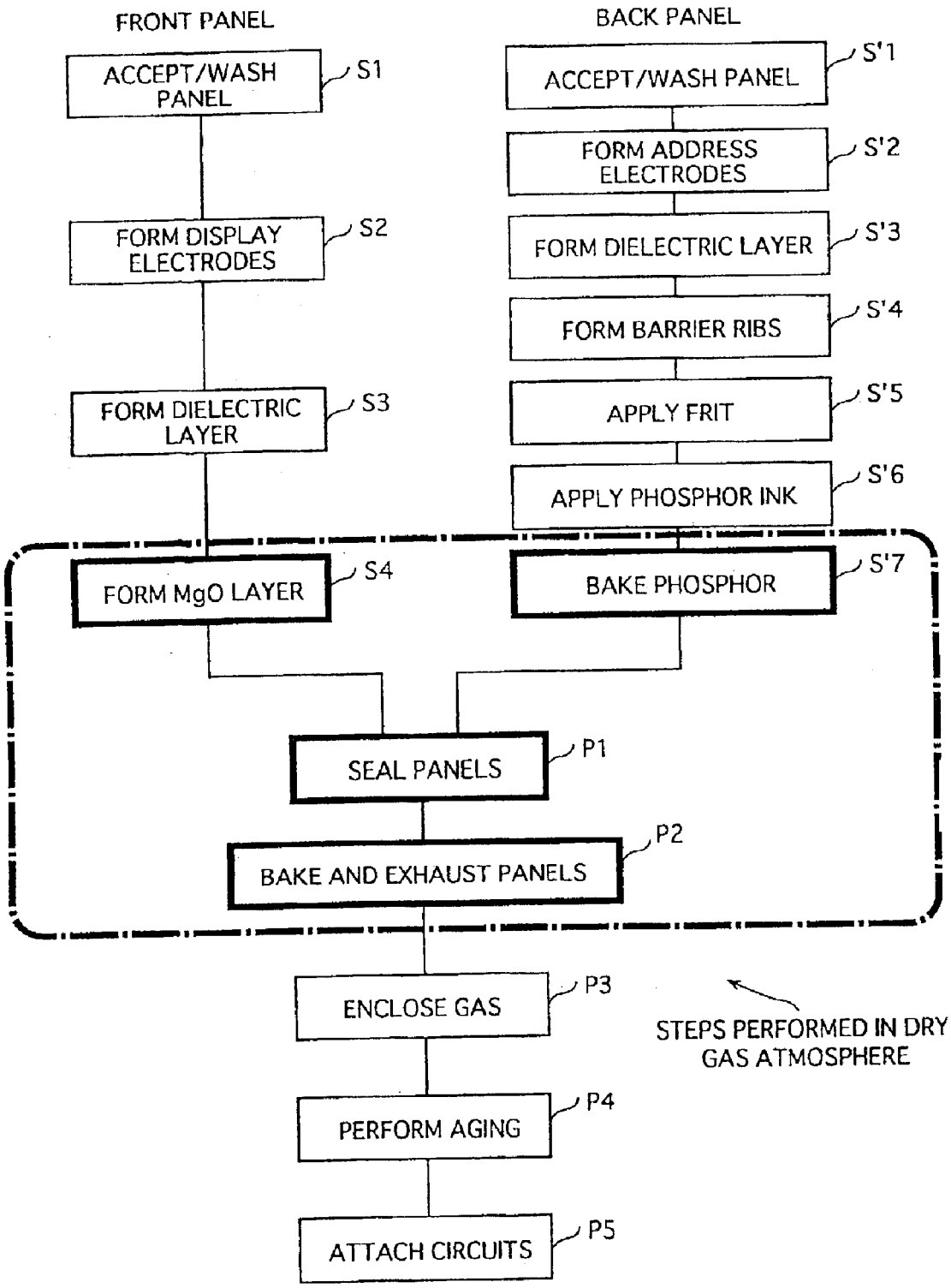
FIG. 2 shows manufacturing steps for the PDP.

The following describes steps of forming the protective layer 15 and the phosphor layers 21 to 23 in detail, with reference to the PDP manufacturing steps shown in FIG. 2. Hereinafter, legends S, S', and P in the figure each denote a step.

2. Manufacturing Method for the PDP 2-1. Manufacturing the Front Panel (Before a Protective Layer is Formed) (S1 to S3)

As the front panel glass 11, a glass plate made of soda lime glass with a thickness of 2.8 mm is prepared. An acceptance test is performed on this glass plate. This test is to check whether a variety in the thickness of the entire glass plate is in a range of ±30 μm inclusive, and whether the surface of the glass plate has cracks, defects, and flaws. A glass plate that has passed this test is used as the front panel glass 11. The front panel glass 11 is washed with a solvent or pure water (S1).

Following this, on the surface of the front panel glass 11, transparent electrodes 120 and 130 each with a thickness of 20 μm are formed in strips using a conductive material such as ITO (Indium Tin Oxide) and $SnO_2$. On the transparent electrodes 120 and 130, bus electrodes 121 and 131 made of three layers of Ag or Cr—Cu—Cr are laminated, to form the display electrodes 12 and 13 (S2). To form these electrodes, a well-known method such as screen printing and photolithography can be employed.

Following this, the entire surface of the front panel glass 11 on which the display electrodes 12 and 13 have been formed is coated with a paste of lead glass, and the front panel glass 11 is baked at a temperature of 400° C. or higher, to form the dielectric layer 14 with a thickness being in a range of 20 to 30 μm (S3).

2.2 Manufacturing the Back Panel (before a Phosphor Layer is Formed) (S'1 to S'6)

As the back panel glass 17, a glass plate made of soda lime glass with a thickness of 2.8 mm is prepared, an acceptance test is performed on this glass plate, and then the glass plate is washed (S'1). Note here that the step S'1 is the same as the step S1.

Following this, on the surface of the back panel glass 17, a conductive material mainly composed of Ag is applied in stripes at fixed intervals by screen printing, to form the address electrodes 18 each with a thickness of 5 μm (S'2) To manufacture a PDP to be fitted in a 40-inch class high-definition TV, the distance between two adjacent electrodes 18 sandwiching a barrier rib 20 needs to be set at about 200 μm or less.

Following this, on the entire surface of the back panel glass 17 on which the address electrodes 18 have been formed, a paste of lead glass is applied, and the back panel glass 17 is baked, to form the dielectric layer 14 with a thickness being in a range of 20 to 30 μm (S'3).

Following this, a paste is prepared using a lead glass material that is the same as that used for the dielectric layer 14. The surface of the dielectric layer 14 is then coated with this paste, to form a glass layer with a thickness of about 80 μm. Top portions of the address electrodes 18 are removed by sandblasting, so that the barrier ribs 20 each with a height of 80 μam and a width of 30 μm are patterned. Then, the barrier ribs 20 are baked and each formed between every two adjacent address electrodes 18 (S'4).

The barrier ribs 20 may be formed with a method other than the above-described method. For example, the barrier ribs 20 may be formed by directly printing the above glass material so as to fit in the widths of the barrier ribs 20 over a plurality of times by screen printing, and baking the printed glass material.

Following this, a glass frit for sealing is applied to a peripheral part of the back panel glass 17 (see the back panel 16 shown in FIG. 3 described later) by screen printing (S'5). Here, a thickness of the glass frit is set at about 20 μm. After being applied, the glass frit is dried for a predetermined time period, to partially volatilize an organic solvent therein, so as to reduce the fluidity.

Following this, on side surfaces of two adjacent barrier ribs 20 and on a portion of the dielectric layer 14 surface that is exposed between the side surfaces of the two adjacent barrier ribs 20, phosphor ink containing one of R, G, and B phosphors is applied (S'6).

Here, the following gives examples of phosphors for use in a PDP. Shown right side of a colon is the luminescence center.

| | |
|---|---|
| red phosphor | $(Y_xGd_{1-x})\ BO_3$: $Eu^{3+}$ |
| green phosphor | $Zn_2SiO_4$: Mn |
| blue phosphor | $BaMgAl_{10}O_{17}$: $Eu^{3+}$ (or $BaMgAl_{14}O_{23}$: $Eu^{3+}$) |

Phosphor particles with an average particle size of about 3 μm can be used as a phosphor material. As a method for applying phosphor ink, screen printing may be employed. However, it is more preferable to employ a method of scanning along grooves formed between two adjacent barrier ribs 20 while applying the ink from an extra-thin nozzle, for preventing different colors of phosphor ink applied into adjacent grooves from being mixed and also for preventing the phosphor ink and a glass frit from interfering.

2-3. Assembling the PDP Using Dry Gas Atmosphere Apparatus (S4, S'7, P1, and P2)

As a characteristic of the first embodiment, a dry gas atmosphere apparatus that is a manufacturing apparatus for the PDP is used to realize the steps of: forming the protective layer of the front panel; baking the phosphors of the back panel; sealing the front and back panels together; and baking and exhausting the front and back panels.

Figure 3:
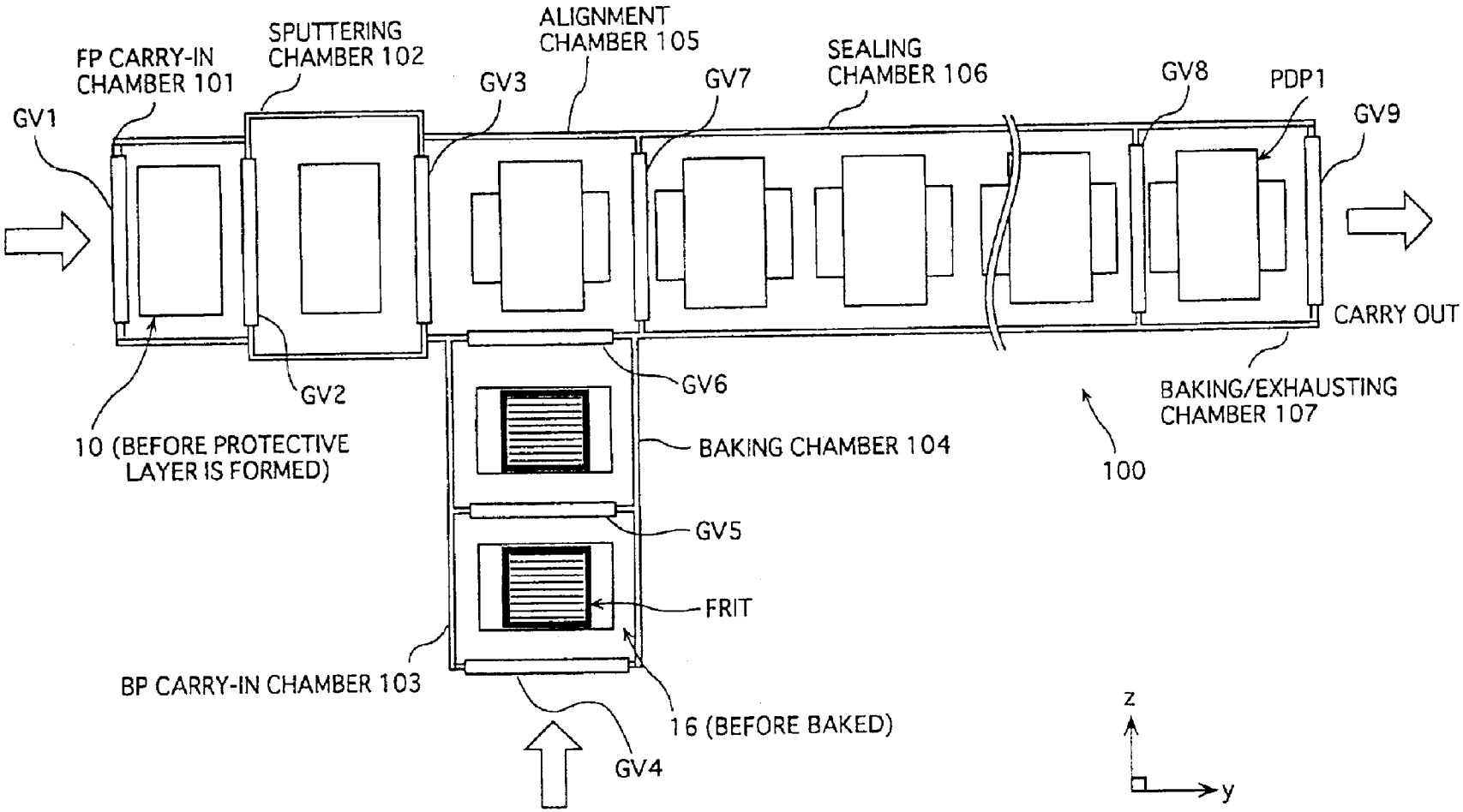
FIG. 3 is a sectional side elevation view of a dry gas atmosphere apparatus.

FIG. 3 is a simplified view showing the internal construction of a dry gas atmosphere apparatus 100 as viewed from the above. As the figure shows, the dry gas atmosphere apparatus 100 has a box casing. The inside of the casing is divided by shutter-type gate valves (GVs) 1 to 9, to form a front panel (FP) carry-in chamber 101, a sputtering chamber 102, a back panel (BP) carry-in chamber 103, a baking chamber 104, an alignment chamber 105, a sealing chamber 106, a baking/exhausting chamber 107, etc. The GVs 1 to 9 slide open and close in the vertical direction (the direction z).

Figure 4:
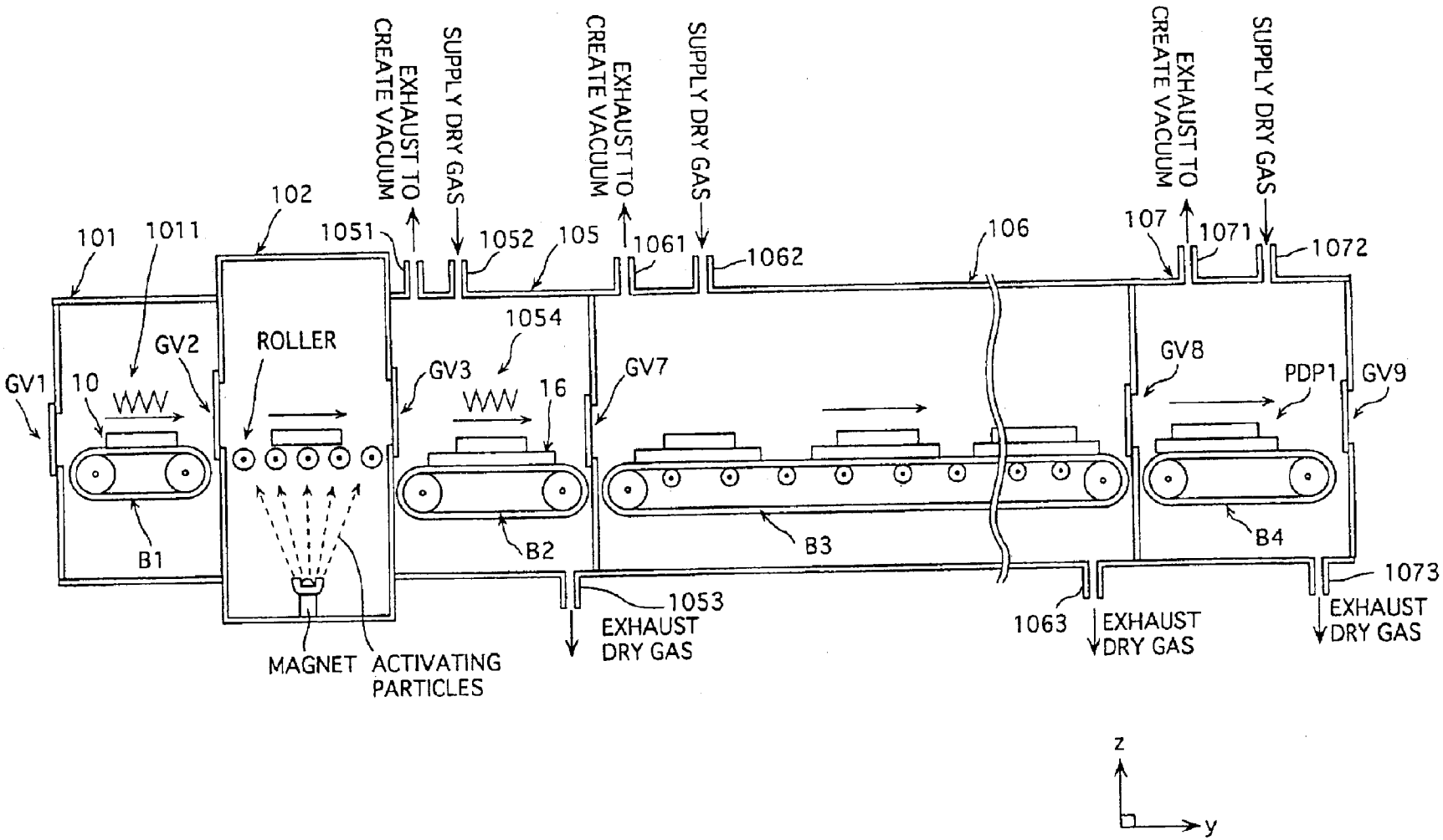
FIG. 4 is a sectional top elevation view of the dry gas atmosphere apparatus.

FIG. 4 is a sectional side elevation view of the dry gas atmosphere apparatus 100 taken in the direction y in FIG. 3. To simplify the drawing, the baking chamber 104 is not shown in the figure.

The dry gas atmosphere apparatus 100 includes belt-driving devices B1 to B4 (and a belt-driving device for the baking chamber that is not shown), each of which can carry the panel in the direction y (the belt-driving device for the baking chamber 104 can carry the panel in the direction z) by rotating carry belts without ends that are set on driver and follower rollers. The front panel 10 and the back panel 16 are respectively carried in from the FP carry-in chamber 101 and the BP carry-in chamber 103 are arranged one on top of the other in the alignment chamber 105 after going through the baking chamber 104 and the sputtering chamber 102 respectively. The front panel 10 and the back panel 16 arranged one on top of the other are then carried into the baking/exhausting chamber 107 after going through the sealing chamber 106.

The baking chamber 104, the alignment chamber 105, the sealing chamber 106 and the like respectively have vacuum-exhausting outlets 1051, 1061, 1071, . . . , dry gas inlets 1052, 1062, 1072, . . . , and dry gas outlets 1053, 1063, 1073, . . . . The dry gas outlets are respectively provided for exhausting dry gases circulated through the chambers 104, 105, and 106. The dry gas inlets and outlets can be open and close, and are used to adjust a gas amount and a pressure within each chamber. The vacuum-exhausting outlets 1051, 1061, 1071, . . . are each connected to a vacuum pump, whereas the dry gas inlets 1052, 1062, 1072, . . . are each connected to a dry gas supply pump. The FP carry-in chamber 101, the BP carry-in chamber 103, the baking chamber 104, and the like also each have a vacuum-exhausting outlet, a dry gas inlet, and a dry gas outlet, although they are not shown for simplifying the drawing.

The dry gas referred to herein is assumed to be a dry gas atmosphere having a vapor partial pressure of 10 mPa or lower. This dry gas is a gas atmosphere with a reduced vapor partial pressure compared with a conventional case, in view of minimizing an amount of moisture absorbed from the atmosphere into the protective layer 15 made of magnesium oxide in the protective layer forming step. The vapor partial pressure of 10 mPa or lower is a value that has resulted from devoted examinations of the inventors of the present application. As one example, such a dry gas can be obtained by subjecting air to a drying process. To be more specific, each dry gas supply pump can be constructed by a compressor with an air filter, and a dry gas can be obtained by removing moisture and impurities from the air taken in by this compressor. Alternatively, instead of the air filter, a moisture-removing device may be used to freeze and remove moisture contained in the air through liquid nitrogen, or a moisture-removing device filled with silica gel may be used. Alternatively, moisture contained in a gas may be frozen and removed through a freezing process by the above compressor.

A dry gas to be supplied to the baking chamber 104, the alignment chamber 105, the sealing chamber 106, etc. may be other than the dry gas obtained by subjecting air to a drying process, as long as it has a vapor partial pressure of 10 mPa or lower. As this kind of dry gas, an argon gas is considered favorable in view of its availability and price. Nitrogen may also be used as this dry gas, but in this case, an unfavorable reducing reaction may occur due to an electric discharge and the like. In view of this, it is preferable to use a gas that is more inert. To create an atmosphere in which the phosphor layers 21 to 23 and the glass frit are baked, it is preferable to supply an oxygen gas or a gas containing oxygen to the baking chamber 104 and the sealing chamber 105.

When a dry gas is used, it is preferable to set a pressure in each chamber equal to or higher than an atmospheric pressure (positive pressure). By doing so, an air flow into each chamber can be prevented and thereby an increase in a vapor amount within each chamber can be avoided.

Also, instead of using a dry gas, a gas atmosphere with a reduced vapor amount may be created by depressurizing to 1 Pa or lower.

The inventors have found that it is preferable to set a dew point of these gas atmospheres in a range of −70 to −30° C., so that a moisture amount contained in the gas can be reduced further. Basically, the dew point at least needs to be set at −30° C. or lower to produce this effect. However, cooling the gas atmosphere down below −70° C. induces a cost increase, and therefore, the above temperature range is considered preferable.

From the dry gas inlets 1052, 1062, 1072, . . . , one out of two gases, namely an argon gas and a dry gas obtained by subjecting air to a drying process can be supplied by switching between these two gases.

The FP carry-in chamber 101 is equipped with an electro thermal heater 1011. The front panel 10 on which the baked dielectric material has been baked is carried into the FP carry-in chamber 101, where the front panel 10 is heated to a temperature of approximately 120° C. or higher.

The sputtering chamber 102 is equipped with a well-known sputtering apparatus. As FIG. 4 shows, activating particles are adhered, from the magnet side, to the front panel with the dielectric layer that has been carried on the rollers from the FP carry-in chamber 101, so as to form a protective layer made of magnesium oxide (MgO) with a thickness of 1 μm. This sputtering chamber 102 also has a vacuum-exhausting outlet, a dry gas inlet, and a dry gas outlet (not shown). The sputtering chamber 102 is exhausted to create a vacuum therein via the vacuum-exhausting outlet, and then an argon gas that functions both as a dry gas and a reaction gas is supplied via the dry gas inlet. It should be noted here that the sputtering chamber 102 may be supplied with another gas that is mainly composed of a nitrogen gas or a mixture of oxygen and neon. Instead of the sputtering chamber 102, a protective layer formation chamber may be provided where a protective layer can be formed using a well-known vapor deposition method or a chemical vapor deposition (CVD) method. In this case, too, an atmosphere within this chamber needs to be the above dry gas atmosphere when the apparatus 1 is driven.

The alignment chamber 105 is equipped with a well-known optical alignment apparatus. The front panel 10 and the back panel 16 are aligned by optically aligning a position of an alignment marker put in advance on the front panel 10 with a position of an alignment marker put in advance on the back panel 16. Further, the alignment chamber 105 is further equipped with an electro thermal heater 1054. The front and back panels respectively carried in from the sputtering chamber 102 and the baking chamber 104 can be heated at a temperature in a range of 120 to 150° C. by this electro thermal heater 1054. This temperature is set in accordance with a known temperature at which moisture is less liable to adhere to each panel. Also, a heating temperature of the front and back panels may be set at other temperatures such as 220° C. and 340° C., so that moisture is even less liable to adhere thereto (Reference; "*Gas Emission/Absorption Characteristics of Internal Coating Materials for CRT (I) to (III)*" Shinku 37(1994) 116, 38(1995) 788, 40(1997) 449, written by Masao Hashiba et al).

It is needless to say here that the heating temperature is to be set based on a heat-resistant temperature of each panel.

The inner walls of the baking chamber 104 and the sealing chamber 106 are coated with a heat-resistant material. The baking chambers 104 and the sealing chamber 106 are each equipped with a heater (not shown), and so the inside of these chambers can be heated.

The operation timings of the belt-driving devices B1 to B4, the GVs 1 to 9, the vacuum-exhausting outlets 1051, 1061, 1071, . . . , the dry gas outlets 1053, 1063, 1073, . . . , the dry gas inlets 1052, 1062, 1072, . . . , the vacuum pumps, the dry gas supply pumps, the alignment apparatus, etc. are controlled by a personal computer (PC) connected to the dry gas atmosphere apparatus 100. More specifically, the PC controls various conditions such as open and close states of the GVs 1 to 9, a baking temperature, a sealing temperature, a rotation speed of a carry belt, a supply speed of a dry gas, a timing of vacuum-exhausting, a pressure in a chamber, and the like. These conditions can be adjusted by an operator inputting values via the PC terminal. With this control, each of the chambers 101 to 107 does not allow outside air to come in, and is filled with a dry gas atmosphere having a vapor partial pressure of 10 mPa or lower.

Figure 5:
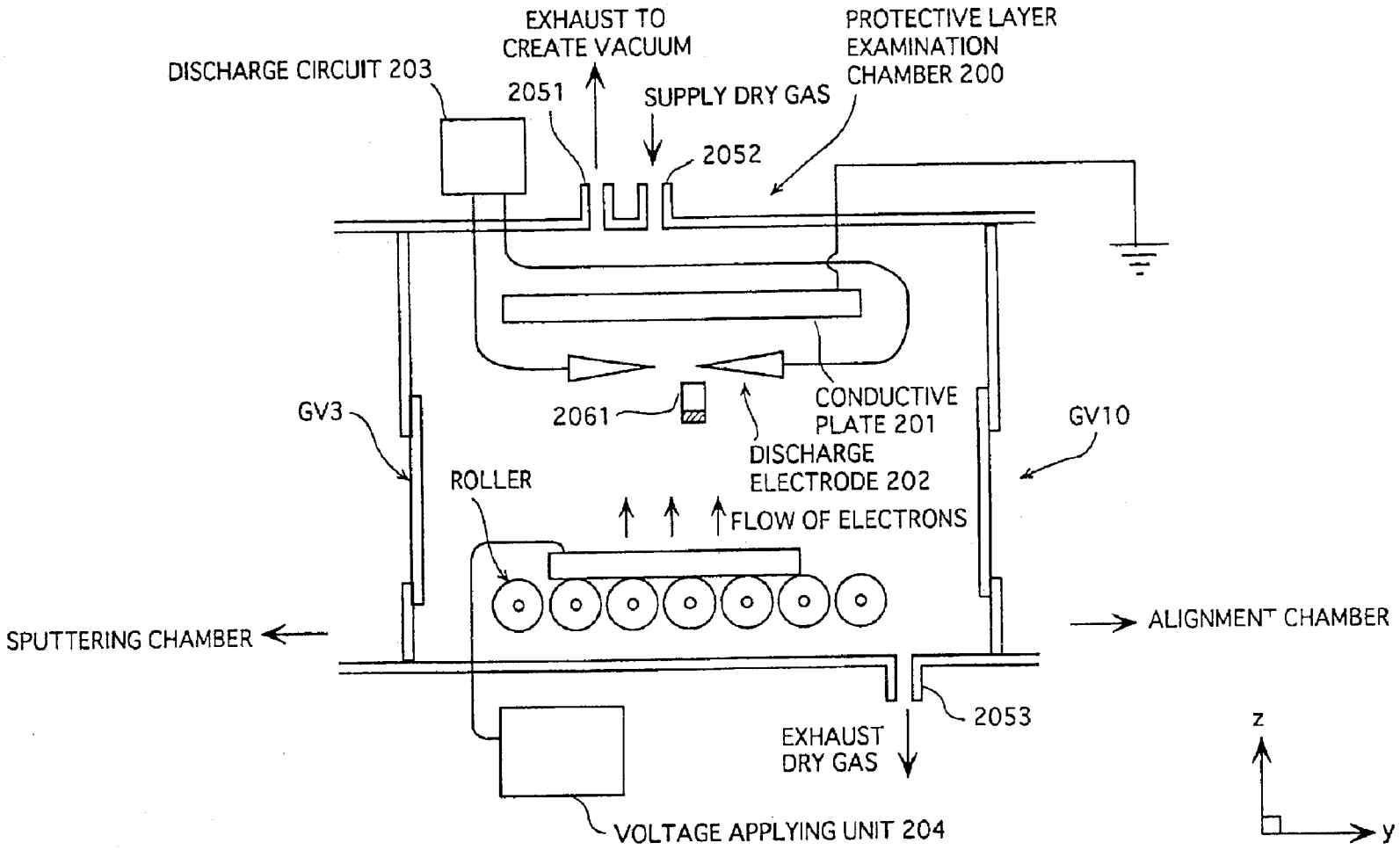
FIG. 5 shows the construction of a protective layer examination chamber.
Figure 6:
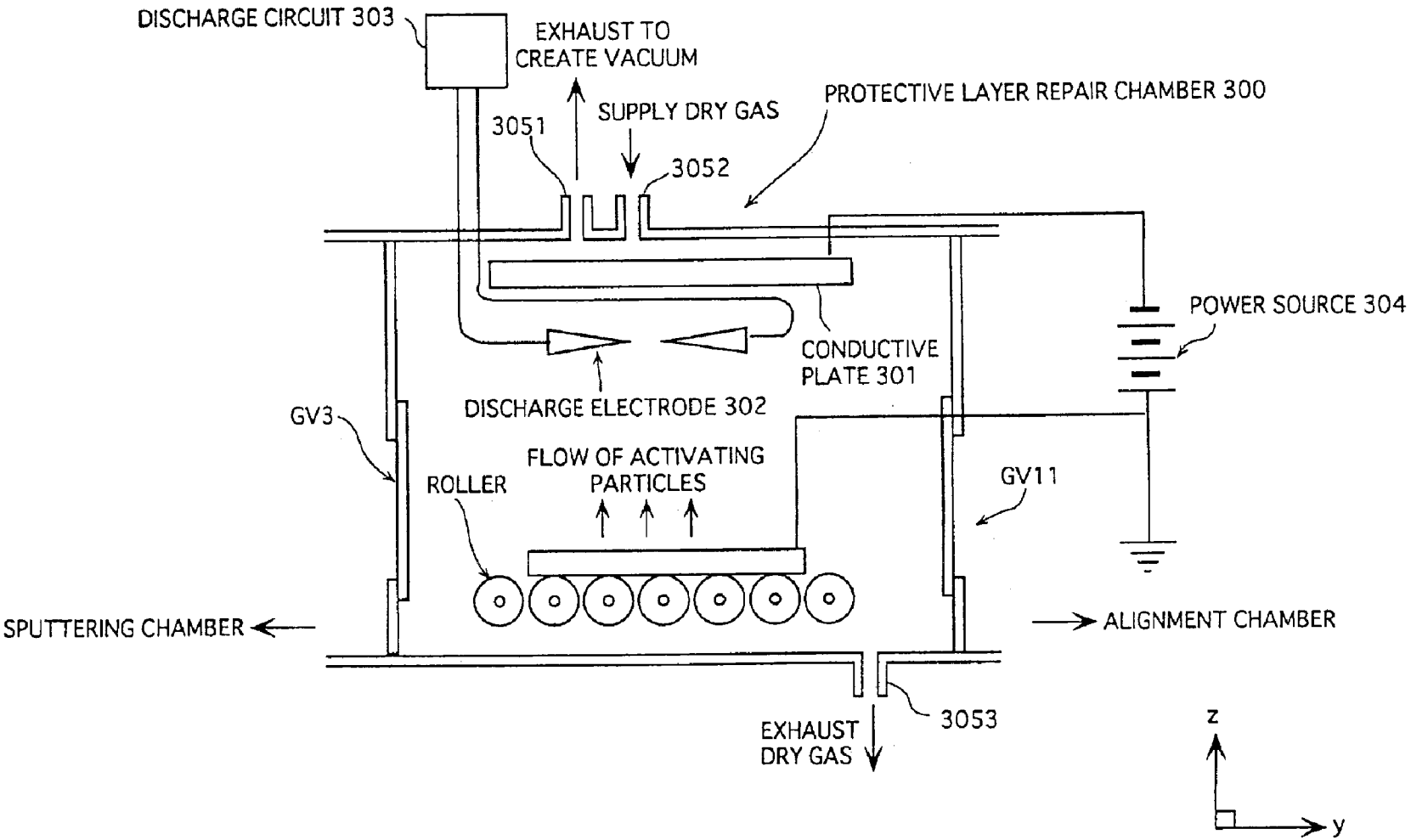
FIG. 6 shows the construction of a protective layer repair chamber.

Further, the sputtering chamber 102, the baking chamber 104, the alignment chamber 105, and the sealing chamber 106 are equipped with electrodes for causing an electric discharge (see FIG. 5 and FIG. 6 described later). After the chambers 101 to 107 are filled with a discharge gas, power is supplied to these electrodes, to cause an electric discharge. This electric discharge aims at reducing generation of static electricity within each chamber, and also, at depositing and decomposing impurities within the chamber.

The following describes the operation of this dry gas atmosphere apparatus 100. When the dry gas atmosphere apparatus 100 is driven, the GVs 1 to 9, the dry gas outlets 1053, 1063, 1073, . . . , and the dry gas inlets 1052, 1062, 1072, . . . are first closed. The chambers 101 to 107 are then exhausted to create vacuums using the vacuum pumps connected to the vacuum-exhausting outlets 1051, 1061, 1071, . . . . A depressurizing value here is, for example, $1.33*10^{-1}$ mPa. Following this, a trace of argon gas (several to several tens sccm) is supplied into each of the chambers 101 to 107, so that an electric discharge is performed in each chamber (for about 1 minute). With this operation, a cleaning step of each chamber is performed, with impurities adhered to the wall surface of each chamber being removed, and further, generation of static electricity within each chamber can be prevented. To realize this cleaning step, only one of the vacuum-exhausting and the electric discharge may be performed. However, to form the protective layer 15 and the phosphor layers 21 to 23 with good quality, it is preferable to perform both of the vacuum-exhausting and the electric discharge.

After the electric discharge, a predetermined dry gas is supplied into each chamber. Here, adhered impurities in each chamber have already been removed, and so a gas atmosphere with high purity can be created while a vapor partial pressure within each chamber is being reduced, compared with a conventional case.

An argon gas is supplied into the sputtering chamber 102, and a dry gas obtained by subjecting air to a drying process is supplied into each of the chambers 101, and 103 to 107. An amount of dry gas within each chamber may be set, for example, at several to several tens sccm (in a normal state). The amount of dry gas can be adjusted by opening and closing the dry gas inlets 1052, 1062, 1072, . . . , and the dry gas outlets 1053, 1063, 1073, . . . .

The front panel 10 on which the dielectric layer has been formed (gradually having been cooled down from approximately 400° C.) is first placed in the FP carry-in chamber 101 by an operator, and is heated to a temperature of 120° C. or higher by the heater 1011. Following this, as FIG. 4 shows, the front panel 10 is carried into the sputtering chamber 102 by belt-driving device B1 driving and rotating operations. In the sputtering chamber 102, the protective layer 15 is formed on the front panel 10 (S4). A heating temperature at the time of sputtering is set in a range of 150 to 200° C. The front panel 10 is then carried into the alignment chamber 105.

It should be noted here that a step of cleaning the protective layer 15 may be provided before the front panel 10 is carried into the alignment chamber 105. To be more specific, this cleaning step may be realized by a method of discharging a surface of the protective layer 15, an ion beam radiation method, a baking method (300 to 450° C.), an ultraviolet ray radiation method, etc.

On the other hand, the back panel 16 on which phosphor ink and a glass frit have been applied (a glass frit is indicated by a thick line in FIG. 3) is carried from the BP carry-in chamber 103 into the baking chamber 104, where the back panel 16 is baked (S'7). Here, a heating temperature is set at a temperature at which phosphor ink is to be baked (approximately 450° C.). The back panel 16 that has been subject to the baking step is carried into the alignment chamber 105 by the belt-driving device that is not shown in the figure.

Like the case of the protective layer 15, a step of cleaning the phosphor layer may be provided before the back panel 16 is carried into the alignment chamber 105. To be more specific, this cleaning step may be realized by a method of discharging a surface of the phosphor layer, an ultraviolet radiation method, etc. It is also preferable to perform this cleaning step in the above-described gas atmosphere.

As FIG. 4 shows, in the alignment chamber 104, such an alignment operation that arranges the front panel 10 on the back panel 16 at correct positions is performed. The heater 1054 equipped in the alignment chamber 104 heats the front and back panels 10 and 16 at substantially the same temperature (120 to 150° C.). Here, the front and back panels are in a high temperature state immediately after the protective layer has been formed and the phosphor layer has been baked respectively. This means that the panels are carried into the subsequent sealing chamber 106 and are subject to the sealing step without having been cooled down much (P1). Accordingly, the panels can be heated quickly in the sealing step, contributing to a decrease in the manufacturing cost.

In the sealing step, the panels need to be heated at a temperature being in a range of 150 to 650° C. Here, because heat in the panels is retained in the alignment chamber 104, the heating temperature of the panels required in the sealing step can be achieved quickly. The PDP 1 that has passed through the GV 8 by the belt-driving devices B2, B3, and B4 rotating and driving operations is carried into the baking/exhausting chamber 107, where the PDP 1 is subject to the baking/exhausting step (P2).

With the method using the dry gas atmosphere apparatus 100 described above, the front panel 10 and the back panel 16 can be subject to manufacturing steps from the protective layer 15 formation step and the phosphor layers 21 to 23 formation step through the baking and exhausting step, in a dry gas atmosphere without coming in contact with outside air. Accordingly, an amount of moisture absorbed into the protective layer 15 from the atmosphere can be substantially reduced, compared with a conventional case, and also, the protective layer 15 with high purity can be formed with less impurities.

Here, phosphors are generally subject to thermal degradation (discoloring) when heated in a state of containing moisture. With the above-described method, however, the baking/exhausting step is performed without phosphors coming in contact with outside air. Accordingly, thermal degradation of the phosphors can be avoided. Also, an amount of absorbed moisture in the protective layer 15 can also be reduced, and therefore, chances of moisture moving from the protective layer 15 toward the phosphor layers 21 to 23 can be reduced to a great extent.

2.4 Assembly of the PDP (P3 to P5)

After the sealing step is completed, the PDP is taken out of the baking/exhausting chamber 107, and then is subject to a baking/exhausting step at a temperature of approximately 350° C. or lower. A high vacuum ($1.1*10^{-1}$ mPa) is created in the discharge space 24. Then, a discharge gas composed of Ne—Xe (5%) is enclosed into the discharge space 24 at a pressure of approximately $6.7*10^{5}$ Pa (P3). It is also preferable to perform the step P2 in the presence of a dry gas with a low vapor partial pressure, or under a reduced pressure, for minimizing an amount of moisture present inside the PDP.

Following this, aging is performed to stabilize each driving circuit, the protective layer 15, and the phosphor layers 21 to 23 within the PDP 1 (P4). To be more specific, a voltage of 250V is applied to the PDP 1 in which the panels are bonded together, and the PDP 1 is driven for several to several tens hours in a state where its screen is performing white display. Aging is generally to be performed for about 2 hours for a 13-inch PDP, and about 8 hours for a 42-inch PDP. However, aging may be performed for a longer time period (e.g. 10 to 24 hours).

Following this, a driving circuit (driver IC) is attached to the PDP, and housings, cabinets, acoustic components, etc. are incorporated into the PDP. Then, a clamping step and the like are performed, to complete the PDP (P5).

3. Others

For the above dry gas atmosphere apparatus 100, trays that hold the panels may be used. In this case, the trays holding the panels thereon may be placed on carry belts of the belt-driving devices B1 to B4. Here, a tray may bring with it impurities adhered thereto into a chamber from outside, and therefore, it is preferable to separately prepare trays for outside use for carrying the panels from outside air into the carry-in chambers 101 and 103, and trays for inside use for being used within the apparatus 100, and to transfer the panels from the trays for outside use to the trays for inside use. By doing so, a dry gas within each chamber can be prevented from being contaminated with impurities that have been adhered to the trays in outside air.

Also, in the dry gas atmosphere apparatus 100, not only the alignment chamber but also the FP carry-in chamber may be equipped with a heater, so that the front panel immediately after the dielectric layer has been formed can be heated before being carried into the sputtering chamber. This can produce the effect of reducing an amount of heat required at the time of sputtering.

Also, the above embodiment describes the case where the FP carry-in chamber 101 is equipped with the heater 1011 and the alignment chamber 105 is equipped with the heater 1054, to heat both of the front panel 10 and the back panel 16. However, because the back panel 16 receives a sufficient amount of baking heat in the baking chamber 104, at least only the front panel on which the protective layer 15 has been formed may be heated.

Also, although the above embodiment describes the case where the sputtering chamber 102 and the alignment chamber 105 are provided continuously, a storage chamber for storing the front panel 10 immediately after the protective layer has been formed and that has been carried out from the sputtering chamber 102 may be provided between the sputtering chamber 102 and the alignment chamber 105. The front panel 10 may be heated by a heater equipped in the storage chamber, before being carried into the alignment chamber 105.

Further, in the dry gas atmosphere apparatus 100, a protective layer examination chamber may be provided between the sputtering chamber 102 and the sealing chamber 106. Here, FIG. 5 shows the construction in which a protective layer examination chamber 200 is provided between the sputtering chamber 102 and the alignment chamber 105.

According to the example in the figure, the protective layer examination chamber 200 has a vacuum-exhausting outlet 2051, a dry gas inlet 2052, a dry gas outlet 2053, and GVs 3 and 10, as the alignment chamber 105 and other chambers. In the upper part within the chamber 200, a grounded conductive plate 201, and a pair of discharge electrodes 202 connected to a discharge circuit 203 are arranged. In the lower part within the chamber 200, rollers are arranged in parallel, and a voltage applying unit 204 and the like are connected to the display electrodes 12 and 13 of the front panel 10 on which the protective layer has been formed and that is carried on the rollers. Below the discharge electrodes 202, a photo-electric element 2061 is arranged and fixed, with its sensor unit being directed toward the front panel 10. The photo-electric element 2061 is connected to a PC type protective layer examination apparatus that is not shown, and detection values of the photo-electric element 2061 are observed. Also, outputs of the discharge circuit 203 provided to the discharge electrodes 202 are also observed by the PC type protective layer examination apparatus. Due to this, a ratio of secondary electron generation amount from the protective layer 15 with respect to a discharge scale of the discharge electrodes 202 is calculated. The PC type protective layer examination apparatus reads a control program dedicated to this calculation.

Although not shown for simplifying the drawing, the protective layer examination chamber 200 is provided with an external gate valve that enables the panel to be taken out from outside of the apparatus.

With the protective layer examination chamber 200 having the above-described construction, the front panel 10 immediately after the protective layer 15 has been formed is exposed to an electric discharge (ion) generated by the discharge electrodes 202, generating electrons (secondary electrons) from the surface of the protective layer 15 toward the conductive plate 201. The protective layer examination apparatus measures (a) an amount of secondary electrons using a detection value of the photo-electric element 2061 and (b) a discharge scale (an amount of ions) using an output of the discharge circuit 203 to the discharge electrodes 202, and examines the surface of the protective layer 15 of the front panel 10 carried on the rollers. Then, based on whether a detected amount of secondary electrons generated on the surface of the protective layer varies depending on parts or not, the uniformity of the entire protective layer 15 is examined. When the formed protective layer 15 is defective (for example, the protective layer 15 is assumed to be defective when an amount of secondary electrons is a predetermined value or more), an alarm is transmitted to an operator, with the GVs 3 and 10 being kept closed. Then, the operator takes the front panel 10 out from the external gate valve.

With this operation, the front panel 10 whose protective layer 15 is found to have a predetermined level of defect can be removed before being combined with the back panel 16. Compared with a case where a completed PDP is examined, manufacturing process yields can be improved drastically, thereby effectively reducing the manufacturing cost.

Also, in the dry gas atmosphere apparatus 100, a protective layer repair chamber (a protective layer cleaning chamber) may be provided between the sputtering chamber 102 and the sealing chamber 106. FIG. 6 shows the construction in which a protective layer repair chamber 300 is provided between the sputtering chamber 102 and the alignment chamber 105.

According to the example in the figure, the protective layer repair chamber 300 has a vacuum-exhausting outlet 3051, a dry gas inlet 3052, a dry gas outlet 3053, and GVs 3 and 11. In the upper part within the chamber 300, a conductive plate 301 connected to a power source 304 together with the front panel 10 (either of a DC power source or an RF power source can be used, as long as activating particles can flow from the panel toward the conductive plate) and a pair of discharge electrodes 302 connected to the discharge circuit 303 are arranged. In the lower part within the chamber 300, a dry gas mainly composed of argon is supplied as in the sputtering chamber 102.

With the protective layer repair chamber 300 having the above-described construction, the front panel 10 immediately after the protective layer 15 has been formed can generate activating particles from the protective layer toward the conductive plate 201 by an electric discharge of an argon gas generated by the discharge electrodes 201. This can produce the effect of subjecting the surface of the protective layer 15 to sputtering, and thereby smoothing the surface of the protective layer 15.

Also, both of the protective layer examination chamber 200 and the protective layer repair chamber 300 may be provided. In this case, it is preferable to provide the chambers 200 and 300 continuously between the sputtering chamber 102 and the sealing chamber 106.

Also, although the above embodiment describes the case where the steps S4, S'7, P1, and P2 are performed continuously in a dry gas atmosphere with the use of the dry gas atmosphere apparatus 100, the present invention should not be limited to such. For example, at least one of the steps S4, S'7, P1, and P2 may be performed using an independent apparatus. It should be noted however that the plates need to be kept in a dry gas atmosphere during and after each step.

Also, the above embodiment describes the case where a dew point in a gas atmosphere used in the sealing step P1 may be lower than that in the other steps S4, S'7, and P2. However, when the phosphor layer cleaning step is provided, a dew point in the phosphor layer baking step S'7 and the phosphor layer cleaning step may be set lower than in the other steps S4, P1, and P2.

Further, the above embodiment describes the case where a gas atmosphere with a different dew point may be created in some of the chambers 101, 103, 104, 105, 106, and 107. In this case, it is preferable to create a gas atmosphere with a different dew point in at least two of the steps S4, S'7, P1, and P2, and to set a pressure of the gas atmosphere with a lower dew point higher than a pressure of the gas atmosphere with a higher dew point. This is because the gas atmosphere with a relatively small amount of water vapor can be prevented from flowing into the gas atmosphere with a relatively large amount of waver vapor.

What is claimed is:

1. A manufacturing method for a plasma display panel, comprising:

a protective layer forming step of forming a protective layer on one main surface of a first plate, the protective layer protecting a dielectric layer;

a phosphor layer baking step of baking a phosphor layer that has been applied on one main surface of a second plate;

a sealing step of sealing the first plate and the second plate that have been placed in such a manner that the main surface on which the protective layer has been formed faces the main surface on which the phosphor layer has been baked; and a baking and exhausting step of baking the first plate and the second plate while exhausting a space formed between the first plate and the second plate, wherein in each of the four steps and between every successive two of the four steps, the first plate and the second plate are continuously in a first gas atmosphere with a dew-point temperature of −30° C. or lower, or in a second gas atmosphere with a pressure of 1 Pa or lower.

2. A manufacturing method for a plasma display panel according to claim 1, wherein in the phosphor layer baking step and the sealing step, the first gas atmosphere or the second gas atmosphere contains an oxygen gas or an oxygen gas element.

3. A manufacturing method for a plasma display panel according to claim 1, wherein at least the phosphor layer baking step and the sealing step are performed while a constituent of the first gas atmosphere or the second gas atmosphere is being circulated.

4. A manufacturing method for a plasma display panel according to claim 1, wherein the protective layer forming step is performed by a sputtering method or a vapor deposition method, and in the protective layer forming step, the first gas atmosphere or the second gas atmosphere contains one of an inert gas, an oxygen gas, and a nitrogen gas.

5. A manufacturing method for a plasma display panel according to claim 1, wherein a temperature of the first plate is kept at 120° C. or higher, during an interval between an end of the protective layer forming step and a start of the sealing step.

6. A manufacturing method for a plasma display panel according to claim 1, further comprising a protective layer cleaning step of cleaning the protective layer, the protective layer cleaning step being provided between the protective layer forming step and the sealing step.

7. A manufacturing method for a plasma display panel according to claim 6, wherein the protective layer cleaning step is performed in the first gas atmosphere or in the second gas atmosphere.

8. A manufacturing method for a plasma display panel according to claim 7, wherein the protective layer cleaning step is performed by a method selected from (a) a method of discharging a surface of the protective layer, (b) a method of radiating the protective layer with an ion beam, (c) a method of baking the protective layer, and (d) a method of radiating the protective layer with an ultraviolet ray.

9. A manufacturing method for a plasma display panel according to claim 1, wherein a dew point of the first gas atmosphere and a dew point of the second gas atmosphere are in a range of −70 to −30° C. inclusive.

10. A manufacturing method for a plasma display panel, comprising:

a protective layer forming step of forming a protective layer on one main surface of a first plate, the protective layer protecting a dielectric layer;

a phosphor layer baking step of baking a phosphor layer that has been applied on one main surface of a second plate;

a sealing step of sealing the first plate and the second plate that have been placed in such a manner that the main surface on which the protective layer has been formed faces the main surface on which the phosphor layer has been baked; and a baking and exhausting step of baking the first plate and the second plate while exhausting a space formed between the first plate and the second plate, wherein in each of the four steps and between every successive two of the four steps, the first plate and the second plate are continuously in a first gas atmosphere with a dew-point temperature of −30° C. or lower, or in a second gas atmosphere with a pressure of 1 Pa or lower, and wherein one or more closed chambers are used in the protective layer forming step, the phosphor layer baking step, the sealing step, and the exhausting and baking step, and between every successive two of the four steps, and when the first gas atmosphere with a dew-point temperature of −30° C. or lower is created in the one or more closed chambers, the first gas atmosphere is adjusted in advance to have a positive pressure that is equal to or higher than an atmospheric pressure.

11. A manufacturing method for a plasma display panel, comprising:

a protective layer forming step of forming a protective layer on one main surface of a first plate, the protective layer protecting a dielectric layer;

a phosphor layer baking step of baking a phosphor layer that has been applied on one main surface of a second plate;

a sealing step of sealing the first plate and the second plate that have been placed in such a manner that the main surface on which the protective layer has been formed faces the main surface on which the phosphor layer has been baked; and a baking and exhausting step of baking the first plate and the second plate while exhausting a space formed between the first plate and the second plate, wherein in each of the four steps and between every successive two of the four steps, the first plate and the second plate are continuously in a first gas atmosphere with a dew-point temperature of −30° C. or lower, or in a second gas atmosphere with a pressure of 1 Pa or lower, and wherein in the protective layer forming step, the first gas atmosphere or the second gas atmosphere contains an oxygen gas with an oxygen concentration being set in advance higher than an oxygen concentration of an atmosphere.

12. A manufacturing method for a plasma display panel, comprising:

a protective layer forming step of forming a protective layer on one main surface of a first plate, the protective layer protecting a dielectric layer;

a phosphor layer baking step of baking a phosphor layer that has been applied on one main surface of a second plate;

a sealing step of sealing the first plate and the second plate that have been placed in such a manner that the main surface on which the protective layer has been formed faces the main surface on which the phosphor layer has been baked; and a baking and exhausting step of baking the first plate and the second plate while exhausting a space formed between the first plate and the second plate, wherein in each of the four steps and between every successive two of the four steps, the first plate and the second plate are continuously in a first gas atmosphere with a dew-point temperature of −30° C. or lower, or in a second gas atmosphere with a pressure of 1 Pa or lower, and wherein a temperature of the first plate and a temperature of the second plate are kept in a range of 120 to 150° C. inclusive, immediately before the sealing step is performed.

13. A manufacturing method for a plasma display panel, comprising:

a protective layer forming step of forming a protective layer on one main surface of a first plate, the protective layer protecting a dielectric layer;

a phosphor layer baking step of baking a phosphor layer that has been applied on one main surface of a second plate;

a sealing step of sealing the first plate and the second plate that have been placed in such a manner that the main surface on which the protective layer has been formed faces the main surface on which the phosphor layer has been baked; and a baking and exhausting step of baking the first plate and the second plate while exhausting a space formed between the first plate and the second plate, wherein in each of the four steps and between every successive two of the four steps, the first plate and the second plate are continuously in a first gas atmosphere with a dew-point temperature of −30° C. or lower, or in a second gas atmosphere with a pressure of 1 Pa or lower, and wherein when the protective layer cleaning step is performed by the method of baking the protective layer, the first plate on which the protective layer has been formed is heated at a temperature being in a range of 300 to 450° C. inclusive.

14. A manufacturing method for a plasma display panel, comprising:

a protective layer forming step of forming a protective layer on one main surface of a first plate, the protective layer protecting a dielectric layer;

a phosphor layer baking step of baking a phosphor layer that has been applied on one main surface of a second plate;

a sealing step of sealing the first plate and the second plate that have been placed in such a manner that the main surface on which the protective layer has been formed faces the main surface on which the phosphor layer has been baked; and a baking and exhausting step of baking the first plate and the second plate while exhausting a space formed between the first plate and the second plate, wherein in each of the four steps and between every successive two of the four steps, the first plate and the second plate are continuously in a first gas atmosphere with a dew-point temperature of −30° C. or lower, or in a second gas atmosphere with a pressure of 1 Pa or lower, and a phosphor layer cleaning step of cleaning the phosphor layer, the phosphor layer cleaning step being provided between the phosphor layer baking step and the sealing step.

15. A manufactunng method for a plasma display panel according to claim 14, wherein in the phosphor layer baking step and the phosphor layer cleaning step, a dew point of the first gas atmosphere or the second gas atmosphere is lower than in the sealing step, the protective layer forming step, and the baking and exhausting step.

16. A manufacturing method for a plasma display panel according to claim 14, wherein the phosphor layer cleaning step is performed in the first gas atmosphere or in the second gas atmosphere.

17. A manufacturing method for a plasma display panel according to claim 16, wherein the phosphor layer cleaning step is performed by a method selected from (a) a method of discharging a surface of the phosphor layer and (b) a method of radiating the phosphor layer with an ultraviolet ray.

18. A manufacturing method for a plasma display panel, comprising:

a protective layer forming step of forming a protective layer on one main surface of a first plate, the protective layer protecting a dielectric layer;

a phosphor layer baking step of baking a phosphor layer that has been applied on one main surface of a second plate;

a sealing step of sealing the first plate and the second plate that have been placed in such a manner that the main surface on which the protective layer has been formed faces the main surface on which the phosphor layer has been baked; and a baking and exhausting step of baking the first plate and the second plate while exhausting a space formed between the first plate and the second plate, wherein in each of the four steps and between every successive two of the four steps, the first plate and the second plate are continuously in a first gas atmosphere with a dew-point temperature of −30° C. or lower, or in a second gas atmosphere with a pressure of 1 Pa or lower, and wherein the protective layer forming step, the phosphor layer baking step, the sealing step, and the exhausting and baking step are performed in one or more closed chambers, and before each of the protective layer forming step, the phosphor layer baking step, the sealing step, and the exhausting and baking step is performed, an inside of a corresponding one of the closed chambers is cleaned by causing a discharge within the first gas atmosphere or the second gas atmosphere used therein.

19. A manufacturing method for a plasma display panel according to claim 18, wherein each of the closed chambers is exhausted after being cleaned, and then the first gas atmosphere or the second gas atmosphere is created in each of the closed chambers.

20. A manufacturing method for a plasma display panel, comprising:

a protective layer forming step of forming a protective layer on one main surface of a first plate, the protective layer protecting a dielectric layer;

a phosphor layer baking step of baking a phosphor layer that has been applied on one main surface of a second plate;

a sealing step of sealing the first plate and the second plate that have been placed in such a manner that the main surface on which the protective layer has been formed faces the main surface on which the phosphor layer has been baked; and a baking and exhausting step of baking the first plate and the second plate while exhausting a space formed between the first plate and the second plate, wherein in each of the four steps and between every successive two of the four steps, the first plate and the second plate are continuously in a first gas atmosphere with a dew-point temperature of −30° C. or lower, or in a second gas atmosphere with a pressure of 1 Pa or lower, and wherein in the sealing step, a dew point of the first gas atmosphere or the second gas atmosphere is lower than in the protective layer forming step, the phosphor layer baking step, and the baking and exhausting step.

21. A manufacturing method for a plasma display panel, comprising:

a protective layer forming step of forming a protective layer on one main surface of a first plate, the protective layer protecting a dielectric layer;

a phosphor layer baking step of baking a phosphor layer that has been applied on one main surface of a second plate;

a sealing step of sealing the first plate and the second plate that have been placed in such a manner that the main surface on which the protective layer has been formed faces the main surface on which the phosphor layer has been baked; and a baking and exhausting step of baking the first plate and the second plate while exhausting a space formed between the first plate and the second plate, wherein in each of the four steps and between every successive two of the four steps, the first plate and the second plate are continuously in a first gas atmosphere with a dew-point temperature of −30° C. or lower, or in a second gas atmosphere with a pressure of 1 Pa or lower, and wherein when at least two of the protective layer forming step, the phosphor layer baking step, the sealing step, and the exhausting and baking step use gas atmospheres each having a different dew point, a pressure of the gas atmosphere with a lower dew point is set higher than a pressure of the gas atmosphere with a higher dew point.

22. A manufacturing apparatus for a plasma display panel, comprising:

protective layer forming means for forming a protective layer on one main surface of a first plate, the protective layer protecting a dielectric layer;

phosphor layer baking means for baking a phosphor layer that has been applied on one main surface of a second plate;

sealing means for sealing the first plate and the second plate that have been placed in such a manner that the main surface on which the protective layer has been formed faces the main surface on which the phosphor layer has been baked; and baking and exhausting means for baking the first plate and the second plate while exhausting a space formed between the first plate and the second plate, wherein the protective layer forming means, the phosphor layer baking means, the sealing means, and the exhausting and baking means are positioned in one or more closed chambers, when the manufacturing apparatus is driven, spaces in and between the one or more closed chambers each contain a first gas atmosphere with a dew-point temperature of −30° C. or lower, or a second gas atmosphere with a pressure of 1 Pa or lower.

23. A manufacturing apparatus for a plasma display panel according to claim 22, further comprising protective layer temperature keeping means for keeping a temperature of the first plate immediately after being carried out from the protective layer forming means at 120° C. or higher.

24. A manufacturing apparatus for a plasma display panel according to claim 22, wherein the protective layer forming means, the phosphor layer baking means, the sealing means, and the baking and exhausting means each include at least gas circulating means for circulating a gas atmosphere into the one ore more closed chamber when the manufacturing apparatus is driven.

25. A manufacturing apparatus for a plasma display panel according to claim 22, further comprising protective layer cleaning means for cleaning the protective layer formed on the first plate that has been carried out from the protective layer forming means.

26. A manufacturing apparatus for a plasma display panel, comprising:

protective layer forming means for forming a protective layer on one main surface of a first plate, the protective layer protecting a dielectric layer;

phosphor layer baking means for baking a phosphor layer that has been applied on one main surface of a second plate;

sealing means for sealing the first plate and the second plate that have been placed in such a manner that the main surface on which the protective layer has been formed faces the main surface on which the phosphor layer has been baked; and baking and exhausting means for baking the first plate and the second plate while exhausting a space formed between the first plate and the second plate, wherein the protective layer forming means, the phosphor layer baking means, the sealing means, and the exhausting and baking means are positioned in one or more closed chambers, when the manufacturing apparatus is driven, spaces in and between the one or more closed chambers each contain a first gas atmosphere with a dew-point temperature of −30° C. or lower, or a second gas atmosphere with a pressure of 1 Pa or lower, protective layer examination means for examining the protective layer formed on the first plate before the first plate is carried into the sealing means.

27. A manufacturing apparatus for a plasma display panel according to claim 26, further comprising protective layer cleaning means for cleaning the protective layer formed on the first plate that has been carried out from the protective layer forming means, wherein the protective layer cleaning means is discharge means for discharging the main surface of the first plate on which the protective layer has been formed.

28. A manufacturing apparatus for a plasma display panel according to claim 26, further comprising phosphor layer cleaning means for cleaning the phosphor layer formed on the second plate that has been carried out from the phosphor layer baking means.

29. A manufacturing apparatus for a plasma display panel according to claim 28, wherein the phosphor layer cleaning means is either discharge means for discharging the main surface of the second plate on which the phosphor layer has been formed, or means for radiating the second plate with an ultraviolet ray.

* * * * *